US010002731B2

(12) United States Patent
Wang et al.

(10) Patent No.: US 10,002,731 B2
(45) Date of Patent: Jun. 19, 2018

(54) ROCKER INPUT MECHANISM

(71) Applicant: Apple Inc., Cupertino, CA (US)

(72) Inventors: Paul X. Wang, Cupertino, CA (US); Ryan P. Brooks, Cupertino, CA (US); Waylon Y. Chen, Fountain Valley, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

(21) Appl. No.: 14/926,618

(22) Filed: Oct. 29, 2015

(65) Prior Publication Data

US 2017/0069447 A1 Mar. 9, 2017

Related U.S. Application Data

(60) Provisional application No. 62/215,532, filed on Sep. 8, 2015.

(51) Int. Cl.

*H01H 13/14* (2006.01)
*H01H 23/28* (2006.01)
*H01H 23/04* (2006.01)

(52) U.S. Cl.

CPC ..... *H01H 23/28* (2013.01); *H01H 23/04* (2013.01); *H01H 2205/002* (2013.01); *H01H 2221/016* (2013.01)

(58) Field of Classification Search

CPC ..... H01H 23/145; H01H 23/30; H01H 2221/012; H01H 2221/016; H01H 13/70; H01H 13/14; H01H 13/705; H01H 3/12; H01H 2221/044

USPC ..... 200/553, 329, 557, 18, 341–345, 5 R, 200/6 A, 17 R

See application file for complete search history.

(56) References Cited

U.S. PATENT DOCUMENTS

| | | | | |
|---|---|---|---|---|
| 4,037,068 | A | 7/1977 | Gaynor | |
| 4,258,096 | A | 3/1981 | LaMarche | |
| 4,324,956 | A | 4/1982 | Sakakino et al. | |
| 4,345,119 | A | 8/1982 | Latasiewicz | |
| 4,581,509 | A | 4/1986 | Sanford et al. | |
| 4,922,070 | A | 5/1990 | Dorkinski | |
| 5,258,592 | A | 11/1993 | Nishikawa et al. | |
| 5,584,380 | A * | 12/1996 | Naitou | H01H 23/145 200/315 |

(Continued)

FOREIGN PATENT DOCUMENTS

| | | |
|---|---|---|
| EP | 2720129 | 4/2014 |
| JP | 3034908 | 3/1997 |
| KR | 20080045397 | 5/2008 |

*Primary Examiner* — Edwin A. Leon
*Assistant Examiner* — Ahmed Saeed
(74) *Attorney, Agent, or Firm* — Brownstein Hyatt Farber Schreck, LLP

(57) ABSTRACT

A rocker input mechanism includes an actuator that is operable to pivot against the interior surface of a housing through which an actuation surface of the actuator projects. Pivots or up-stops on the edges of the actuator are biased against the interior surface by dome switches contacting a switching surface of the actuator that is opposite the actuation surface. Thus, the actuator is able to pivot with respect to the interior surface to activate the dome switches when force is exerted on the actuation surface without bending or flexing like typical rocker buttons. As a result, the rocker input mechanism may have a feel to a user similar to non-rocking input mechanisms like single mode buttons.

21 Claims, 5 Drawing Sheets

(56) References Cited

U.S. PATENT DOCUMENTS

| | | | | |
|---|---|---|---|---|
| 6,355,891 | B1 * | 3/2002 | Ikunami | H01H 23/006 200/315 |
| 6,963,039 | B1 | 11/2005 | Weng et al. | |
| 7,388,167 | B2 | 6/2008 | Liao et al. | |
| 8,167,126 | B2 | 5/2012 | Stiehl | |
| 8,248,815 | B2 | 8/2012 | Yang et al. | |
| 8,263,886 | B2 | 9/2012 | Lin et al. | |
| 8,432,368 | B2 | 4/2013 | Momeyer et al. | |
| 8,446,713 | B2 | 5/2013 | Lai | |
| 8,576,044 | B2 | 11/2013 | Chapman | |
| 8,885,856 | B2 | 11/2014 | Sacha | |
| 9,058,941 | B2 | 6/2015 | Malek et al. | |
| 2002/0063045 | A1 * | 5/2002 | Villain | H01H 25/041 200/5 R |
| 2004/0082414 | A1 | 4/2004 | Knox | |
| 2005/0061640 | A1 * | 3/2005 | Lacroix | H01H 13/70 200/5 R |
| 2009/0312051 | A1 | 12/2009 | Hansson et al. | |
| 2010/0258425 | A1 * | 10/2010 | Takahashi | H01H 1/10 200/339 |
| 2012/0067711 | A1 | 3/2012 | Yang | |
| 2013/0037396 | A1 | 2/2013 | Yu | |
| 2013/0087443 | A1 | 4/2013 | Kikuchi | |
| 2015/0221460 | A1 | 8/2015 | Teplitxky et al. | |
| 2015/0228423 | A1 | 8/2015 | Sanford et al. | |
| 2016/0313703 | A1 | 10/2016 | Ely et al. | |
| 2017/0069443 | A1 | 3/2017 | Wang et al. | |
| 2017/0069444 | A1 | 3/2017 | Wang et al. | |

* cited by examiner

ROCKER INPUT MECHANISM

CROSS-REFERENCE TO RELATED APPLICATION(S)

This application is a nonprovisional patent application of and claims the benefit to U.S. Provisional Patent Application No. 62/215,532, filed Sep. 8, 2015 and titled "Rocker Input Mechanism," the disclosure of which is hereby incorporated herein in its entirety.

FIELD

The described embodiments relate generally to input mechanisms. More particularly, the present embodiments relate to a rocker input mechanism pivotally engaged with a surface though which the input mechanism projects.

BACKGROUND

Electronic devices may utilize a variety of different input mechanisms to receive input from users. Input received from these input mechanisms may be used to control or otherwise change the state of the electronic device. Many electronic devices may include a number of different types of input mechanisms.

One example of an input mechanism is a button or switch. Buttons typically include an actuator that can be pressed to activate a dome switch or other activation assembly. Input from these buttons may generally be interpretable as indicating whether or not the button has been pressed.

Dual rocker buttons or switches may provide the ability to distinguish between multiple inputs. Rather than a binary press or not pressed state, dual rocker buttons may be able to receive presses in two different regions. This dual input ability may be used to receive input to increase and decrease a volume or other setting, navigate directionally in a menu, and so on.

Typically, dual rocker buttons include an elongated actuator with an upper surface that projects through a housing surface and a lower surface mounted on a pivot. Sides of the upper surface may be pressed to pivot the elongated actuator in a particular direction on the pivot, activating one of two domes switches or other activation assemblies positioned under the lower surface on either side of the pivot. This operation causes the elongated actuator to bend or flex to some degree when force is exerted, giving dual rocker buttons a different feel to users than typical single mode buttons.

SUMMARY

The present disclosure relates to a rocker input mechanism. A rocker input mechanism includes an actuator that pivots against the interior surface of a housing through which an actuation surface of the actuator projects. Pivot portions or up-stops on a lip of the actuator are biased against the interior surface by dome switches contacting a switching surface of the actuator that is opposite the actuation surface. The lip may limit the amount the actuator can pivot and may prevent decoupling of the actuator from the housing. Thus, the actuator is able to pivot with respect to the interior surface to activate the dome switches when force is exerted on the actuation surface without bending or flexing like typical rocker buttons. As a result, the rocker input mechanism may have a feel to a user similar to non-rocking input mechanisms like single mode buttons.

In various embodiments, an electronic device includes a housing and a rocker input mechanism. The housing includes an external surface and an internal surface opposite to the external surface. The housing defines an aperture extending from the external surface to the internal surface. The rocker input mechanism includes a button positioned in the aperture. The button has an actuation surface defining first and second actuation regions, a switching surface opposite the actuation surface, a retention lip that has a dimension larger than the aperture and engages the internal surface, and a pivot portion disposed on the retention lip between the first and second actuation regions that pivots against the internal surface.

In some examples, the pivot portion is biased toward the housing. The pivot portion may be biased toward the housing by a dome switch. The pivot portion may have a sloped edge.

In numerous examples, the switching surface includes first and second contact areas that respectively correspond to the first and second actuation regions. The first and second contact areas respectively engage first and second switches.

In some examples, the actuation surface may be flush with the external surface. In other examples, the actuation surface may be recessed into the exterior surface.

In some embodiments, an input mechanism assembly may include a pair of switches, a plate defining an aperture, and an actuator. The actuator is partially positioned in the aperture, pivots against the plate, and is biased toward the plate by the pair of switches.

In various examples, the actuator includes a ring that is separated from the plate by a gap. The actuator may pivot against the plate using an up-stop positioned on the ring. The ring may be operable to constrain motion of the actuator with respect to the plate. A first portion of the ring may move closer to the plate and a second portion of the ring may move farther from the plate when the actuator actuates one of the switches. The ring may contact the plate prevent decoupling of the actuator from the plate In some examples, the switches produce signals indicating whether or not force is exerted on the actuator. In other examples, the switches produce signals indicating an amount of force exerted on the actuator.

In numerous embodiments, an electronic device includes a substrate, a housing, an activator positioned between the substrate and the housing and projecting through the housing, and a rib coupled to the activator that prevents simultaneous activation by the activator of first and second dome switches coupled to the substrate. The activator is pivotally engaged with the housing. A portion of the activator moves transverse to the housing to activate the first and second dome switches.

In various examples, the electronic device further includes a shim coupled to the substrate. The rib engages the shim to prevent simultaneous activation of the first and second dome switches by the activator. The rib may be separated from the shim absent force exerted on the activator. The shim may be positioned between the first and second dome switches.

In some examples, the activator is in contact with the first dome switch when activating the second dome switch. The activator may contact the first and second dome switches in absent force exerted on the activator.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a rocker input mechanism. An actuator is positioned in an aperture defined in a housing and is biased toward the housing by dome switches or other activation assemblies or biasing structures underneath the actuator. Pivot portions on a lip of the actuator contact an internal surface of the housing such that the actuator rotates with respect to the housing. The lip may limit travel of the actuator (for example, while pivoting) and may prevent decoupling of the actuator from the housing. Force exerted on the top surface of the actuator causes the actuator to pivot and activate one of the dome switches. Due to the configuration of the pivot portion and a biasing structure, the actuator does not bend or flex when force is exerted thereon.

A rib or similar component may be positioned underneath the actuator in between where the actuator contacts the dome switches. The rib may engage a shim or portion of a substrate over which the actuator is positioned when force is exerted on the actuator. This may prevent the unpressed side of the actuator from contacting the dome switch underneath when force is exerted on the pressed side. As a result, a force exerted on one side of the actuator may activate a dome switch only beneath that side of the actuator.

These and other embodiments are discussed below with reference to FIGS. 1-4. However, those skilled in the art will readily appreciate that the detailed description given herein with respect to these Figures is for explanatory purposes only and should not be construed as limiting.

Figure 1:
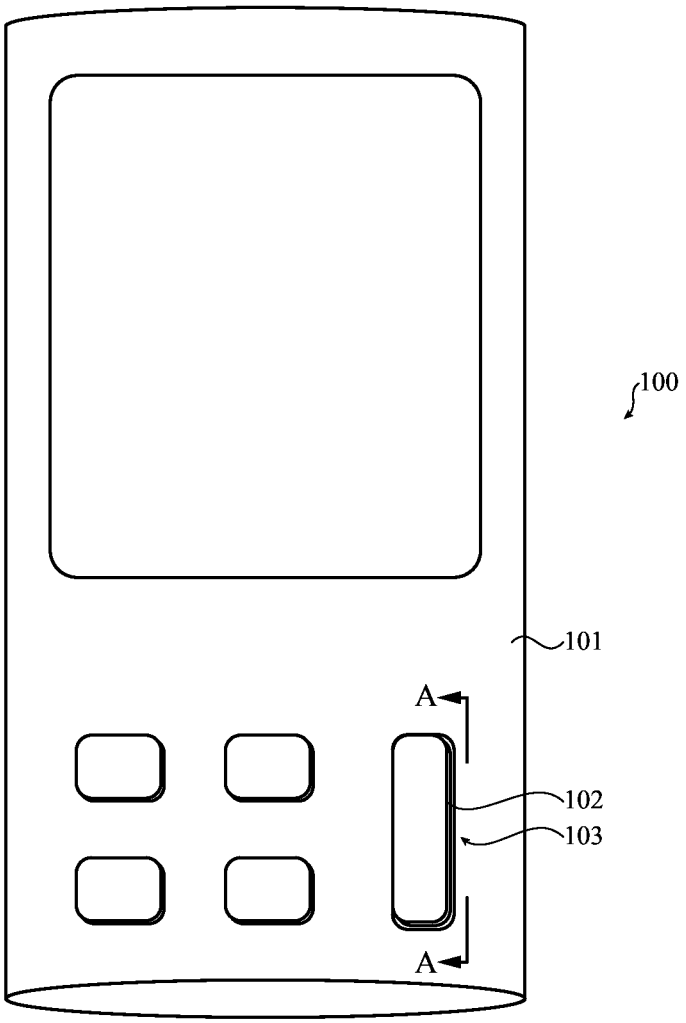
FIG. 1 depicts an electronic device having a rocker input mechanism.

FIG. 1 depicts an electronic device 100 having a rocker input mechanism assembly, which is discussed in more detail below with respect to FIG. 2A. The rocker input mechanism assembly includes an actuator 102, button, or activator that projects at least partially through an aperture 103 defined by a housing 101, top plate, panel, plate, or mount plate of the electronic device 100. The actuator 102 may pivot against an internal surface of the housing using one or more pivots or pivot portions positioned on a retaining ring or retention lip of the actuator 102 that are biased against the internal surface by dome switches or other activation assemblies. Thus, the actuator 102 may pivot such that a portion of the actuator 102 translates about the pivot portion 205 in a direction transverse to the housing 101 when force is exerted on actuation areas of the actuator 102 without bending or flexing.

FIG. 1 depicts the electronic device 100 as a remote control. The actuator 102 can be used to provide dual state input (such as to increase and decrease a volume or other setting, to navigate directionally such as up or down, and so on). However, it is understood that this is an example. In various implementations, the disclosed rocker input mechanism may be used with a variety of different devices without departing from the scope of the present disclosure, such as laptop computing devices, desktop computing devices, keyboards, displays, printers, tablet computing devices, wearable electronic devices, smart phones, digital media players, content receivers, mobile computing devices, and so on.

Figure 2A:
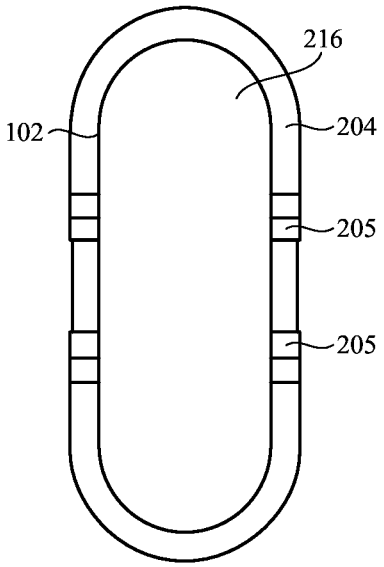
FIG. 2A depicts a top down view of the actuator of FIG. 1 with other components removed for clarity.

FIG. 2A depicts a top down view of the actuator 102 of FIG. 1. The actuator 102 defines an actuation surface 216. Pivot portions 205, on which the actuator 102 pivots against (e.g., is pivotally engaged with) the housing 101 or plate, are disposed on a retaining ring 204 or retention lip.

In FIG. 2A, the retaining ring 204 is shown as forming a continuous perimeter around the edges of the actuator 102. However, it is understood that this is an example. In various implementations, the retaining ring 204 may be formed of separate sections that do not form a continuous perimeter around the edge of the actuator 102 without departing from the scope of the present disclosure.

Further, the pivot portions 205 are shown as particularly shaped portions of the retaining ring 204. For example, the pivot portions 205 are shown as having a sloped or curved edge. The sloped or curved edge of the pivot portions 205 may allow the actuator 102 to pivot easier than a sharp edge. However, it is understood that this is an example. In various implementations, variously shaped pivot portions 205 may be used without departing from the scope of the present disclosure.

Figure 2B:
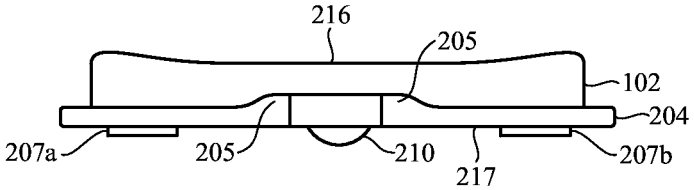
FIG. 2B depicts a side view of the actuator of FIG. 2A.

FIG. 2B depicts a side view of the actuator 102 of FIG. 2A. Switch contact areas 207*a*, 207*b* and a ridge 210 are positioned on a switching surface 217 of the actuator 102 opposite the actuation surface 216.

In FIG. 2B, the pivot portion 205 is shown as an integral portion of the retaining ring 204. However, it is understood that this is an example. In various implementations, the pivot portion 205 may be a separate component coupled to and/or otherwise disposed on the retaining ring 204 without departing from the scope of the present disclosure.

Further, the rib 210 and the contact areas 207*a*, 207*b* are depicted as separate components coupled to the switching surface 217 of the actuator 102. However, it is understood that this is an example. In various implementations, the rib 210 and the contact areas 207*a*, 207*b* may be integrally formed components of the actuator 102 without departing from the scope of the present disclosure.

Additionally, in some implementations, the contact areas 207*a*, 207*b* may be flush with the switching surface 217 rather than components that protrude from the switching surface 217. For example, the contact areas 207*a*, 207*b* may be portions of the switching surface 217 of the actuator 102 that contact the dome switches 208*a*, 208*b* when the actuator 102 is pressed.

Figure 2C:
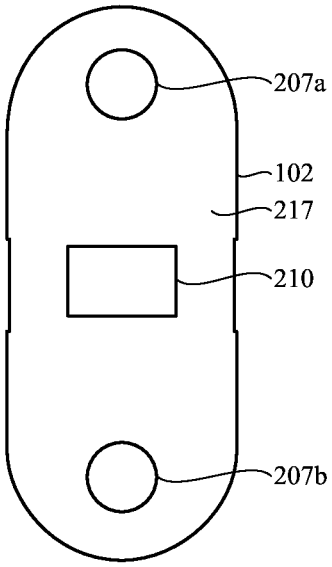
FIG. 2C depicts an underside view of the actuator of FIG. 2A.

FIG. 2C depicts an underside view of the actuator 102 of FIG. 2A showing the switching surface 217. The rib 210 and the contact areas 207*a*, 207*b* are depicted as having particularly shaped configurations. However, it is understood that this is an example. The rib 210 and/or the contact areas 207*a*, 207*b* may be configured with various other shapes without departing from the scope of the present disclosure.

Additionally, the actuator 102 is depicted as having a generally rectangular shaped oval configuration. However, it is understood that this is an example. In various implementations, the actuator 102 may be configured to have various shapes without departing from the scope of the present disclosure. For example, in some implementations, the actuator 102 may have sharp corners rather than rounded as depicted in FIG. 2C.

Figure 3A:
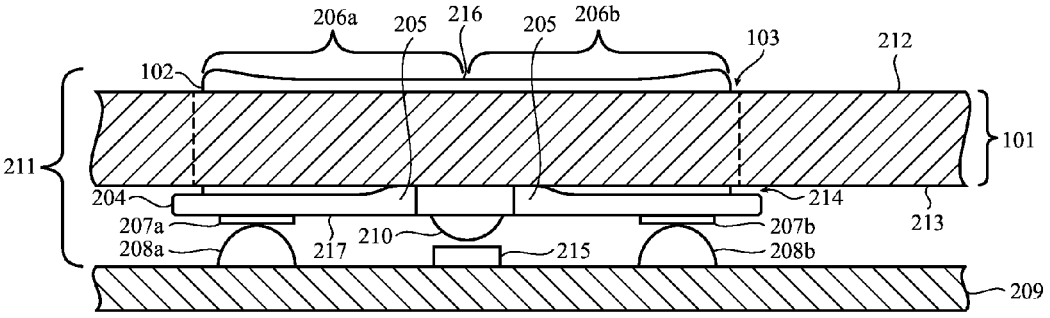
FIG. 3A depicts a partial cross-sectional view of the electronic device of FIG. 1, taken along line A-A of FIG. 1.

FIG. 3A depicts a partial cross-sectional view of the electronic device 100 of FIG. 1, taken along line A-A of FIG. 1. The rocker input mechanism assembly 211 may include the actuator 102, the housing 101 or plate (having an internal or interior surface 213 and an opposite external or exterior surface 212) that defines the aperture 103 (extending from the internal surface 213 to the external surface 212) through which the actuator at least partially projects, and the dome switches 208*a*, 208*b* mounted on or coupled to a substrate 209 (such as a printed circuit board).

Although the top of the actuator 102 is illustrated as proud of the external surface 212, it is understood that this is an example for clarity. In various other embodiments, the top of the actuator 102 (i.e., the actuation surface 216) may be flush with and/or recessed into the external surface 212 without departing from the scope of the present disclosure.

The actuator 102 may define the actuation surface 216 and the switching surface 217 opposite the actuation surface 216. The actuation surface 216 may have a first actuation region 206*a* and a second actuation region 206*b*. The switching surface 217 may have switch contact areas 207*a*, 207*b* that correspond to the first and second actuation regions 206*a*, 206*b*. The switch contact areas 207*a*, 207*b* may respectively contact and engage the dome switches 208*a*, 208*b* to transfer force exerted on one of the first and second actuation regions 206*a*, 206*b* to a respective one of the dome switches 208*a*, 208*b*.

The switch contact areas 207*a*, 207*b* may respectively contact the dome switches 208*a*, 208*b*, absent force exerted on the actuator 102. The dome switches 208*a*, 208*b* may be partially compressed or deformed by that contact such that the dome switches 208*a*, 208*b* are biased toward uncompressing or undeforming. The bias of the partially compressed or deformed dome switches 208*a*, 208*b* may bias the pivot portion or pivot 205 toward the internal surface 213.

The actuator 102 may include a retaining ring 204 or retention lip disposed along an edge of the actuator 102 or integrally formed with the actuator 102. The retaining ring 204 may be separated from the internal surface 213 of the housing 101 by a gap 214 (which may change in dimension as the actuator 102 pivots). The pivot portion 205 (also encompassing an up-stop, a nub, a pivot, and a protrusion) may be positioned, disposed, or otherwise mounted or coupled on the retaining ring 204 in contact with the internal surface 213, allowing the actuator 102 to pivot against the internal surface 213.

The dimension of the gap 214 may determine how far the actuator 102 can pivot with respect to the internal surface 213 on the pivot portion 205. When force is exerted on one side of the actuator 102, actuator 102 pivots on the pivot portion 205 such that the gap 214 between the retaining ring 204 and the internal surface 213 increases and the gap 214 between the retaining ring 204 and the internal surface 213 on the other side decreases. When the retaining ring 204 contacts the internal surface 213 on the other side, eliminating the gap 214, pivoting of the actuator 102 may be stopped. Thus, the pivot portion 205 and the retaining ring 204 may define the motion of the actuator 102 and the gap 214 may constrain that motion.

The retaining ring 204 may have one or more dimensions larger than the aperture 103 such that the retaining ring 204 constrains motion of the actuator 102 with respect to the housing 101. For example, the retaining ring 204 may contact the housing 101 to prevent the actuator 102 from decoupled from the housing 101 and/or being removed through the aperture, may engage the internal surface 213 when force is exerted on the actuator 102 to constrain how far the actuator 102 can pivot, and so on.

In some implementations, the actuator 102 may also include a rib 210, ridge, or similar interference component that may prevent simultaneous actuation or activation of both of the dome switches 208*a*, 208*b*. The rib 210 may be positioned on the switch surface between the switch contact areas 207*a*, 207*b* (thus also between the dome switches 208*a*, 208*b* and the first and second actuation regions 206*a*, 206*b*. The rib 210 may engage a shim 215 or other component (such as the substrate 209) positioned on the substrate 209 when force is exerted on the actuator 102. This may prevent the unpressed side of the actuator 102 from contacting the dome switch 208*a*, 208*b* respectively underneath when force is exerted on the pressed side.

In various implementations, the rib 210 may be separated from the shim 215 absent exerted on the actuator 102. This may prevent the rib 210 and/or the shim 215 from unduly loading the actuator 102 and/or portions thereof against the internal surface 213 and/or housing 101.

In various implementations, the rib 210 may also engage the shim 215 when force is exerted on the actuator at a portion of the actuation surface 216 between the first and second actuation regions 206*a*, 206*b*. This may prevent force exerted on such a middle portion of the actuation surface 216 from activating either of the dome switches 208*a*, 208*b*. As a result, operation of the rocker input mechanism assembly 211 by a user may be restricted to when force is clearly exerted on the first and second actuation regions 206*a*, 206*b*.

However, it is understood that FIG. 3A is an example and that other configurations are possible without departing from the scope of the present disclosure. For example, in some implementations, the shim 215 and/or the rib 210 may be omitted or reverse which contacts a structure under the exertion of force.

Figure 3B:
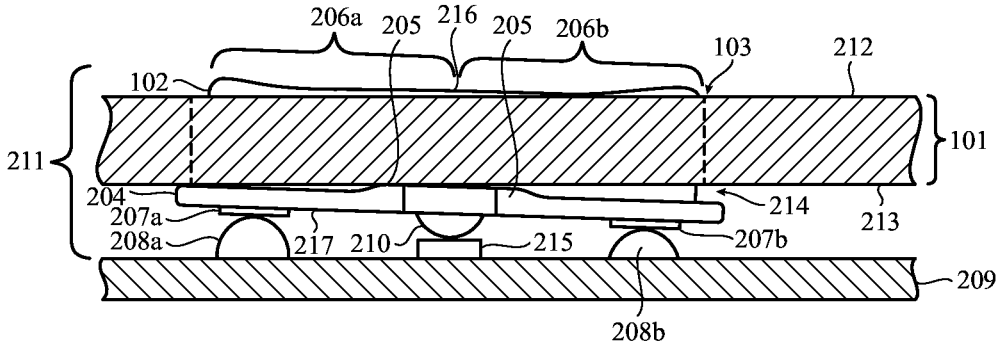
FIG. 3B depicts the view of FIG. 3A when the second actuation region of the rocker input mechanism is actuated.

FIG. 3B depicts the view of FIG. 2A when the second actuation region 206*b* of the rocker input mechanism assembly 211 is actuated. Force exerted on the second actuation region 206*b* may cause the actuator 102 to pivot or translate about the pivot portion 205. The side of the actuator 102 corresponding to the second actuation region 206*b* may lower (with respect to the view depicted in FIG. 2B) while the side of the actuator 102 corresponding to the first actuation region 206*a* may rise. This may cause the contact area 207*b* to transfer the force to the dome switch 208*b*, compressing or deforming and thereby activating or actuating the dome switch 208*b*.

This may also cause the contact area 207*a* to reduce force exerted on the dome switch 208*a*, allowing the dome switch 208*a* to uncompress or undeform to a degree. As a result, the contact area 207*a* may stay in contact with the dome switch 208*a* even when force is exerted on the second actuation region 206*b* rather than the first actuation region 206*a*.

Further, this may cause a first portion of the retaining ring 204 (corresponding to the first actuation region 206*a*) to move closer to the internal surface 213. At the same time, a second portion of the retaining ring 204 (corresponding to the second actuation region 206*b*) may move further from the internal surface 213.

Additionally, the rib 210 may move to contact the shim 215. This may stop or reduce motion of the actuator 102 toward the dome switch 208*a*. As such, the force exerted on the second actuation region 206*b* may be prevented from activating both of the dome switches 208*a*, 208*b*.

Figure 3C:
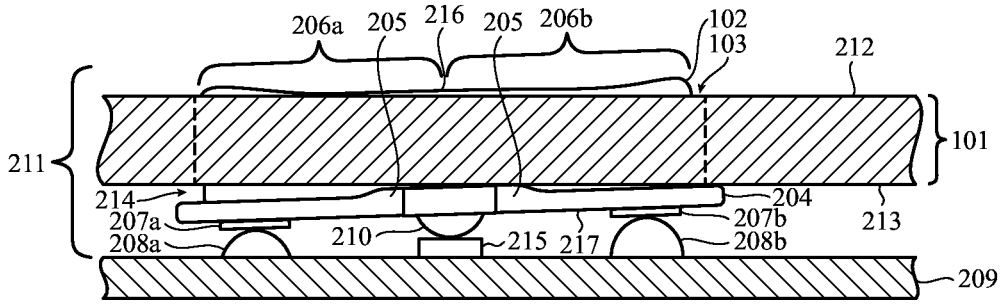
FIG. 3C depicts the view of FIG. 3A when the first actuation region of the rocker input mechanism is actuated.

FIG. 3C depicts the view of FIG. 3A when the first actuation region 206*a* of the rocker input mechanism assembly 211 is actuated. Force exerted on the first actuation region 206*a* may cause the actuator 102 to pivot or translate on the pivot portion 205. The side of the actuator 102 corresponding to the first actuation region 206*a* may lower (with respect to the view depicted in FIG. 3C) while the side of the actuator 102 corresponding to the second actuation region 206*b* may rise. This may cause the contact area 207*a* to transfer the force to the dome switch 208*a*, compressing or deforming and thereby activating or actuating the dome switch 208*a*.

This may also cause the contact area 207*b* to reduce force exerted on the dome switch 208*b*, allowing the dome switch 208*b* to uncompress or undeform to a degree. As a result, the contact area 207*b* may stay in contact with the dome switch 208*b* even when force is exerted on the first actuation region 206*a* rather than the second actuation region 206*b*

Further, this may cause the second portion of the retaining ring 204 (corresponding to the second actuation region 206*b*) to move closer to the internal surface 213. At the same time, the first portion of the retaining ring 204 (corresponding to the first actuation region 206*a*) may move further from the internal surface 213.

Although FIGS. 3A-3C are illustrated and described as activating or not activating the dome switches 208*a*, 208*b* in a purely binary fashion (in other words, the dome switches 208*a*, 208*b* produce signals indicating whether or not force is exerted on the actuator 102), it is understood that this is an example. In some implementations, the dome switches 208*a*, 208*b* may be force sensing dome switches that are operable to produce signals indicating an amount of force out of a range of possible forces exerted on the actuator 102 rather than only indicating whether or not a force is exerted.

Further, although FIGS. 3A-3C are illustrated and described as utilizing dome switches 208*a*, 208*b*, it is understood that other activation mechanisms are possible and contemplated without departing from the scope of the present disclosure. In various implementations, various force sensors, contact pairs, capacitive plates that form a capacitor, optical transmitters and detectors, ultrasonic emitters and detectors, and/or other activation mechanisms may be used in place of the dome switches 208*a*, 208*b*. In implementations where the activation mechanisms themselves do not bias the actuator 102 toward the internal surface 213, other biasing mechanisms such as springs may be used to provide such biasing force.

Additionally, although the rocker input mechanism assembly 211 is illustrated and described above with respect to FIGS. 3A-3C as pivoting in two directions, it is understood that this is an example. In various implementations, such a rocker input mechanism assembly 211 may be configured to operate in modes other than a dual mode (such as a tri-mode rocker input mechanism assembly) without departing from the scope of the present disclosure. For example, in various implementations, a rocker input mechanism assembly 211 constructed according to the techniques described in the present disclosure may pivot in four directions rather than two.

Figure 4:
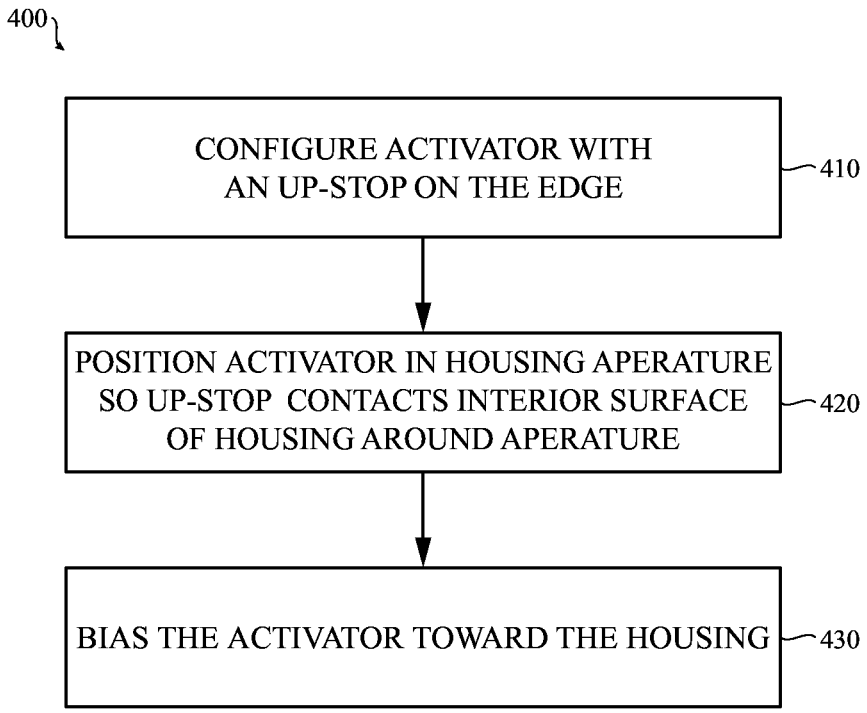
FIG. 4 depicts a method for constructing a rocker button. This method may construct the rocker input mechanism illustrated in FIGS. 1-3C.

FIG. 4 depicts a method 400 for constructing a rocker button. This method may construct the rocker input mechanism assembly 211 illustrated in FIGS. 1-3C.

At 410, an activator may be configured with one or more up-stops on an edge of the activator. The up-stop may be disposed on a lip or ring that forms a perimeter around the edge of the activator.

At 420, the activator may be positioned in a housing or plate aperture. Positioning the activator in the housing aperture may cause the up-stop to contact an interior surface of the housing around the aperture. In some implementations, the housing may be a panel formed of glass and/or other materials.

At 430, the activator may be biased toward the housing. This may bias the up-stop against the interior surface of the housing so that the activator is operable to pivot on the up-stop with respect to the interior surface.

For example, the activator may be biased toward the housing using dome switches or other activation assemblies. In such an example, the activator may be positioned at least partially (the portion that does not project through the aperture) between the housing and the dome switches.

Although the example method 400 is illustrated and described as including particular operations performed in a particular order, it is understood that this is an example. In various implementations, various orders of the same, similar, and/or different operations may be performed without departing from the scope of the present disclosure.

For example, in various implementations, the method may include the additional operation of configuring the activator with one or more components that are operable to constrain or restrict motion of the activator. Such a component may include a retention ring or lip, a rib, and/or other such components.

As described above and illustrated in the accompanying figures, the present disclosure relates to a rocker input mechanism. An actuator is positioned in an aperture defined in a housing and is biased toward the housing by dome switches or other activation assemblies underneath the actuator. Pivots coupled to edges of the actuator contact an internal surface of the housing such that the actuator is operable to pivot with respect to the housing. Force exerted on actuation regions on the top surface of the actuator causes the actuator to pivot and activate one of the dome switches. Due to the configuration of the pivot and the biasing, the actuator does not bend or flex when force is exerted like typical rocker buttons. This may allow the rocker input mechanism to have a feel to a user like non-rocking input mechanisms. In various implementations, a rib or similar component may be positioned underneath the actuator in between where the actuator contacts the dome switches. The rib may be operable to engage a shim or other portion of a substrate over which the actuator is positioned when force is exerted on the actuator. This may prevent the unpressed side of the actuator from contacting the dome switch underneath when force is exerted on the pressed side. As a result, presses on one side of the actuator may be prevented from activating dome switches for both sides.

In the present disclosure, the methods disclosed may be implemented as sets of instructions or software readable or executable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device, comprising:

a housing, comprising:

an external surface; and an internal surface opposite to the external surface; wherein the housing defines an aperture extending from the external surface to the internal surface; and a button positioned in the aperture, comprising:

an actuation surface defining first and second actuation regions;

a switching surface opposite the actuation surface;

a retention lip that has a dimension larger than the aperture and engages the internal surface;

a protrusion extending towards an internal portion of the housing and configured to engage the internal portion of the housing to prevent simultaneous activation of first and second dome switches positioned below the button; and a pivot portion disposed on the retention lip between the first and the second actuation regions and defining a first pivot axis and a second pivot axis different from the first pivot axis; wherein the button is configured to rotate about the first pivot axis in response to an actuation of the first actuation region and to rotate about the second pivot axis in response to an actuation of the second actuation region;

when the button is in an unactuated state, the protrusion is separated from the internal portion of the housing by a gap; and when the button is in an actuated state, the protrusion contacts the internal portion of the housing.

2. The electronic device of claim 1, wherein the pivot portion is biased toward the housing.

3. The electronic device of claim 2, wherein the pivot portion is biased toward the housing by the first dome switch and the second dome switch.

4. The electronic device of claim 1, wherein the actuation surface is at least one of flush with the external surface or recessed into the external surface.

5. The electronic device of claim 1, wherein the pivot portion has a sloped edge.

6. The electronic device of claim 1, wherein the switching surface includes first and second contact areas that respectively correspond to the first and second actuation regions.

7. The electronic device of claim 6, wherein the first and second contact areas respectively engage first and second switches.

8. An input mechanism assembly, comprising:

a pair of switches;

a housing member defining an aperture;

an actuator positioned at least partially in the aperture and biased toward the housing member by the pair of switches, defining:

an exterior surface having first and second actuation regions; and a retaining ring having a raised portion defining two distinct pivot axes inward of the pair of switches;

a support member positioned below the actuator and configured to prevent the actuator from simultaneously actuating the pair of switches, wherein:

the actuator is configured to rotate about a first axis of the two distinct pivot axes in response to an actuation of the first actuation region and to rotate about a second axis of the two distinct pivot axes in response to an actuation of the second actuation region;

when the actuator is in an unactuated state, the support member is separated from the actuator by a gap; and when the actuator is in an actuated state, the support member contacts the actuator.

9. The input mechanism assembly of claim 8, wherein at least a portion of the retaining ring is separated from the housing member by an additional gap.

10. The input mechanism assembly of claim 9, wherein the retaining ring is operable to constrain motion of the actuator with respect to the housing member.

11. The input mechanism assembly of claim 9, wherein a first portion of the retaining ring moves closer to the housing member and a second portion of the retaining ring moves farther from the housing member when the actuator actuates one of the pair of switches.

12. The input mechanism assembly of claim 9, wherein the retaining ring prevents decoupling of the actuator from the housing member.

13. The input mechanism assembly of claim 8, wherein the pair of switches produces signals indicating an amount of force exerted on the actuator.

14. The input mechanism assembly of claim 8, wherein when the actuator is in the unactuated state, only the raised portion of the retaining ring contacts the housing.

15. An electronic device, comprising:

a substrate;

a housing defining an aperture;

an activator defining first and second actuation regions at opposite ends of the activator and projecting through the aperture; and a support structure below the activator;

a rib coupled to the activator that engages the support structure to prevent simultaneous activation by the activator of first and second dome switches coupled to the substrate; wherein:

the activator is configured to:

pivot about a first pivot axis located between the first and second actuation regions in response to a force applied to the first actuation region; and pivot about a second pivot axis located between the first and second actuation regions and different from the first pivot axis in response to a force applied to the second actuation region; and when the activator is in an unactuated state, the rib is separated from the support structure by a gap; and when the activator is in an actuated state, the rib contacts the support structure.

16. The electronic device of claim 15, wherein the support structure is a shim coupled to the substrate.

17. The electronic device of claim 16, wherein the shim is positioned between the first and second dome switches.

18. The electronic device of claim 15, wherein the activator is in contact with the first dome switch when activating the second dome switch.

19. The electronic device of claim 15, wherein the activator contacts the first and second dome switches absent force exerted on the activator.

20. The electronic device of claim 15, wherein:

the activator comprises a pivot portion defining a first fulcrum and a second fulcrum;

the first fulcrum defines the first pivot axis; and the second fulcrum defines the second pivot axis.

21. The electronic device of claim 15, wherein the activator is biased towards the housing by the first and second dome switches.

* * * * *